US006502376B1

(12) United States Patent
Swain

(10) Patent No.: US 6,502,376 B1
(45) Date of Patent: Jan. 7, 2003

(54) SADDLE GIRTH

(75) Inventor: Barry P. Swain, Walsall (GB)

(73) Assignee: Mondial Industries, Ltd., Hudson, OH (US)

( * ) Notice: Subject to any disclaimer, the term of this patent is extended or adjusted under 35 U.S.C. 154(b) by 0 days.

(21) Appl. No.: 09/783,485

(22) Filed: Feb. 14, 2001

(51) Int. Cl.[7] ..... B68C 1/00; B68C 1/14
(52) U.S. Cl. ..... 54/23
(58) Field of Search ..... 54/23, 65, 44.1, 54/46.1, 66; D30/134

(56) References Cited

U.S. PATENT DOCUMENTS

| | | | | | |
|---|---|---|---|---|---|
| 266,571 | A | | 10/1882 | Williams | |
| 2,130,214 | A | | 9/1938 | Wright | |
| 2,239,764 | A | | 4/1941 | Vordemberge | |
| 3,805,491 | A | * | 4/1974 | Deal | 54/23 |
| 3,913,302 | A | * | 10/1975 | Centers, deceased | 54/65 |
| 4,434,604 | A | | 3/1984 | Bird | |
| 4,570,424 | A | | 2/1986 | Simpson | |
| 4,800,709 | A | | 1/1989 | Le Tixerant | |
| 4,999,980 | A | * | 3/1991 | McGowan | 54/23 |
| 5,109,835 | A | * | 5/1992 | McDonald et al. | 606/241 |
| 5,125,219 | A | * | 6/1992 | Sligo | 54/23 |
| 5,329,751 | A | * | 7/1994 | Wadsworth | 54/23 |
| 5,361,952 | A | * | 11/1994 | Gold | 224/159 |
| D367,738 | S | | 3/1996 | Marshall | |
| 5,503,894 | A | * | 4/1996 | Brown | 428/128 |
| 5,566,533 | A | | 10/1996 | Larisch | |
| 5,768,864 | A | * | 6/1998 | Chang | 54/23 |
| 5,816,031 | A | | 10/1998 | Marshall | |
| 5,946,892 | A | * | 9/1999 | Siddoway | 54/23 |
| 5,984,885 | A | * | 11/1999 | Gaylord, Jr. et al. | 602/19 |

* cited by examiner

*Primary Examiner*—Charles T. Jordan
*Assistant Examiner*—Tara M Golba
(74) *Attorney, Agent, or Firm*—Reinhart Boerner Van Deuren s.c.

(57) ABSTRACT

The present invention is a saddle girth to be used in conjunction with an English saddle. The saddle girth has a central portion separating two opposing straight segments, each of which extend from the central portion at an angle less than approximately forty-five degrees to form a chevron-like shape. This style of saddle girth inhibits the saddle from shifting along the back of the horse, thus preventing sores and chafing while providing safety for the rider.

32 Claims, 3 Drawing Sheets

28
26
24
36
22
4
30
21
ø

21
36
30
34
32

20

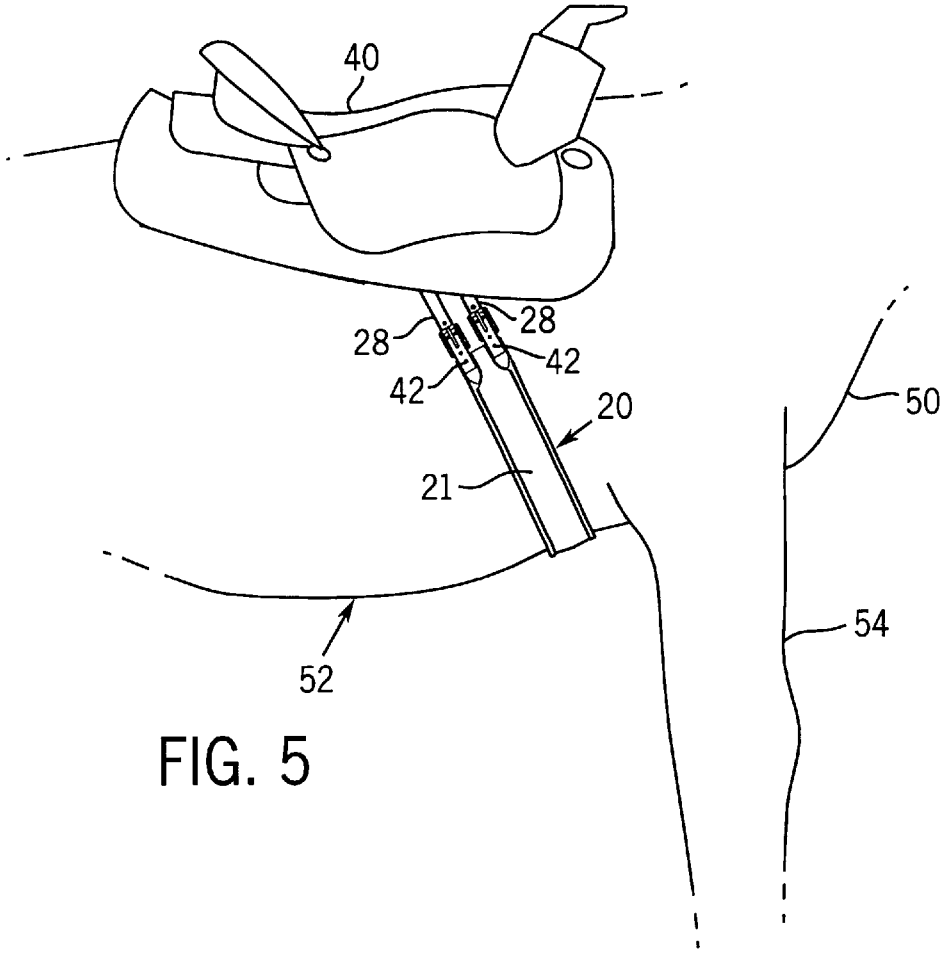
FIG. 5
FIG. 6
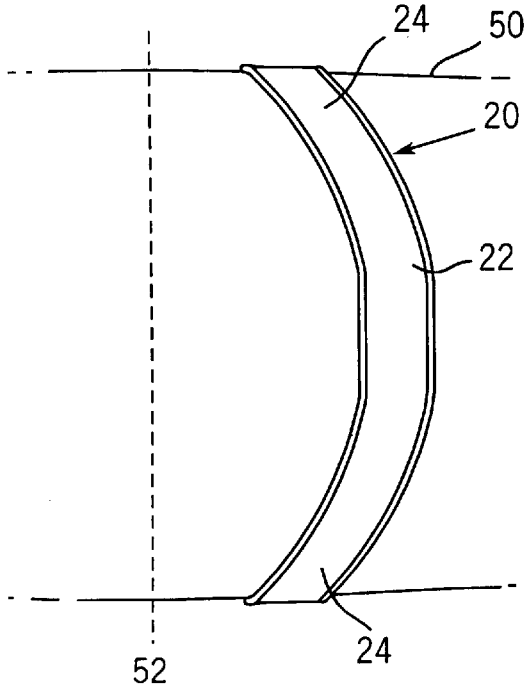

SADDLE GIRTH

BACKGROUND OF THE INVENTION

Field of the Invention

This invention relates generally to a saddle girth for use with horses, and more particularly, to a novel saddle girth that inhibits the saddle from shifting longitudinally along the spine of the horse between the withers and the rump to prevent sores and chafing, thus providing more comfort for the horse, safety for the rider and peace of mind for the empathic horse owner.

Saddle girths for horses are used with all styles of saddles, including the styles of saddle commonly known as "English" and "Western." Girths used with English saddles are typically made of leather and extend around and beneath the chest of the horse. Such a girth usually has two or three buckles at each segment for attachment to a corresponding billet or saddle strap on each side of the saddle. The buckles and/or saddle straps should provide a mechanism to adjust the girth in order to secure the saddle on the back of the horse. Generally, this is accomplished by pulling the saddle strap through the buckle until taut and then holding the saddle strap at that position by inserting the tongue of the buckle through the punch holes of the saddle strap.

Unlike girths used with English saddles, girths used with Western saddles are in the form of a cinch. Western saddles have rigging from both a front girth and a flank girth. Traditionally, one segment of the front girth is connected directly to the saddle while the other segment of the front girth is connected to the opposite side of the saddle by a latigo, which is a long strap on the saddle tree to tighten and fasten the front girth to the saddle. After the saddle is placed on the horse, the latigo is pulled up by hand until the proper tightness of the front girth is obtained. Like the front girth, the flank girth is typically a leather strap that extends from one side of the rear portion of the saddle to the other side behind the rib cage to keep the rear portion of the saddle down on the back of the horse. For a girth to sufficiently hold a Western saddle to a horse and prevent the saddle from slipping or turning, the front girth and the flank girth need to be extremely tight. This causes discomfort to the horse and increases sores and chafing while also restricting the horse's natural breathing.

Girths, especially those used with English saddles, typically allow considerable movement of the saddle laterally and longitudinally on the horse when performing rapid action events such as jumping, dressage or polo. For example, in a polo game, the rider will place more weight on the stirrup on the side of the horse where the ball is to be hit, tending to cause the saddle to laterally rotate several degrees to that side. Saddles also shift along the longitudinal axis of the horse during equestrian events like jumping. This saddle movement is dangerous and disconcerting to the rider and can also cause sores and chafing on the horse's withers, shoulder blades, and/or back. Further, the girth's repeated side-to-side and/or front-to-back movement can irritate the horse's ribcage and/or skin along the chest and sides of the horse.

A primary factor in saddle movement and the associated problems caused thereby is the traditional design of girths. Many popular horses do not have a flat chest but have a barrel or rounded chest, such as Arabian and Quarter horses. A barrel chest is broad at the midsection to form the apex of the chest and narrows considerably toward the front and the rear of the horse. Traditionally, girths have been straight and wrapped across the apex of the horse's chest directly beneath the point at which the girth is attached to the saddle. However, the tapering of the chest away from the apex permits the girth to slide forward and backward along the horse's chest which allows the saddle to slip back and forth longitudinally along the spine of the horse. The solution to date is to further tighten the girth, a solution which is not a good one as far as the horse is concerned.

An example of a saddle girth is shown in U.S. Pat. No. 5,566,533, to Larisch. Larisch discloses a typical saddle girth used to hold an English saddle to a horse. As discussed above, the saddle girth disclosed in Larisch is straight from end-to-end and is pulled across the apex of the horse's chest just beneath the point at which the girth is attached to the saddle. This design allows the girth to slide forward towards the forelegs during use, which loosens both the saddle and girth. This allows the saddle to slide longitudinally along the back of the horse causing sores and chafing while the girth rubs against the chest and forelegs inflicting the same ailments.

Another example of a saddle girth is shown in U.S. Pat. No. 2,130,214, to Wright. Wright discloses a saddle girth that has an S-shaped curve at both ends of the girth near the buckle/saddle to position the rest of the girth in a plane posterior to the portion of the horse at which the girth is attached to the saddle. The curves disclosed in Wright locate the girth across the underside of the horse at a point substantially further back than a traditional saddle girth. Like Larisch, the saddle girth disclosed in Wright has a tendency to shift forward towards the forelegs when the girth is situated over the apex of the horse's chest. Again, this causes the saddle to loosen and shift upon the back of the horse and permits the saddle girth to rub against the chest and forelegs, both causing sores and chafing. If the curves disclosed in Wright are substantial and the girth is located behind the apex of the chest towards the hindlegs, the girth will pass over the lower ribs or behind the rib cage. A girth in this position will cause discomfort and possible internal injury to the horse if overtightened.

One possible way to overcome the problems and disadvantages described above would be by creating a saddle girth that is curved instead of straight. However, saddle girths of this type would fail because they would have a tendency to straighten when tightened or after the girth has been used repeatedly. When straightened, such saddle girths are no better than the traditional saddle girths discussed above.

To overcome the problems and disadvantages of the approaches discussed above, it is an objective of the saddle girth of the present invention to securely hold the saddle on the back of the horse and prevent the saddle from shifting during use. The girth should accomplish this objective by being capable of use with traditional style saddles and wrapping across the horse's chest or sternum area forward the apex of the chest.

It is a further objective that the saddle girth of the present invention retains its position over the sternum area of the horse so that the girth does not rub against the skin or forelegs to cause sores and chafing. The girth should also not be allowed to pass towards the posterior of the horse to cause discomfort or internal damage to the horse.

Another objective of the saddle girth is that it should provide a rider greater stability, comfort and confidence when used in combination with a saddle. The saddle girth should also be constructed to be comfortable to the horse and capable of absorbing perspiration.

Finally, it is also an objective of the saddle girth that all of the aforesaid advantages and objectives be achieved without incurring any substantial relative disadvantage.

SUMMARY OF THE INVENTION

The disadvantages and limitations of the background art discussed above are overcome by a saddle girth for holding a saddle securely on the back of a horse as taught by the present invention. When the saddle girth is used in combination with a saddle, the girth minimizes saddle movement longitudinally along the back of the horse, thereby preventing sores and chafing while providing safety and comfort for horse and rider alike. A brief summary of the invention follows.

The saddle girth is constructed from a girth band having a central portion and two opposing straight segments. Each opposing straight segment extends away from the central portion of the girth band at an angle to form a chevron-shaped girth. The saddle girth may be in the shape of a true chevron, with the two straight segments coming substantially to a point at the central portion, or the girth may have a chevron-like shape with a substantially straight central portion between the two straight segments which are angled with respect to the central portion. The total length of the girth is determined by the size and the shape of the horse, but typically falls between the range of approximately nine-tenths of a meter (0.9 m.) and one and three-tenths meters (1.3 m.), and has a width between approximately five centimeters (5 cm.) and fifteen centimeters (15 cm.).

The central portion may be sized to fit over the sternum of the horse which is the strongest portion of the horse's chest. In addition, the circumference of the chest at this point remains more constant during breathing than does the lower chest area. These characteristics permit the girth to be sufficiently tightened around the horse while providing the horse with the greatest degree of comfort. The length of the central section will typically not exceed approximately thirty-two centimeters (32 cm.), and may at the other extreme have no length at all (i.e., the central portion is entirely eliminated). In other embodiments, the central portion may have a longer length to extend the central portion beyond the sternum area.

The angle by which each opposing straight segment extends away from the central portion may also vary with the shape and size of the horse, the position of the saddle and the length of the central portion. The angle will be smaller when the horse is smaller, the saddle is forward on the back of the horse and/or the central portion becomes shorter in length. If any of these factors are inversed, the angle will have to be increased accordingly. Generally, each straight segment will be at an angle less than approximately forty-five degrees (45°) as measured from the central portion, but will usually fall between the range of approximately one degree (1°) and thirty degrees (30°). Most often, however, the angle will be in the range of approximately five degrees (5°) and ten degrees (10°) as this is sufficient to properly locate the girth around the chest of the horse and to position the girth for removable attachment to the saddle.

Each opposing segment has one or more straps that extend beyond the distal end of each segment and are affixed to the girth band by stitching or other wellknown methods. The straps may vary in size and form and may extend across the entire girth band or be joined to the girth band near each distal end of the straight segment. Additionally, the number of straps may vary depending on the style of saddle and how the girth is to be connected to the saddle. Most often, the straps will have a connector, such as a buckle, to attach the girth to the saddle straps of the saddle. The buckle may be a conventional buckle with a frame and a tongue or any other type of connector that can be removably attached to the saddle strap. The connector allows the girth to be adjusted so that the girth may be either loosened or tightened around the horse.

The girth band has an outside surface which will face away from the horse and an inside surface which will be positioned against the body of the horse when the girth is removably attached to the saddle. The outside surface is joined to the inside surface by stitching or other well-known methods known by those skilled in the art. To provide additional comfort for the horse, a cushion may be inserted between the outside surface and the inside surface. This cushion may be constructed from foam, rubber, neoprene, gel-filled polymer or any other type of cushioning material that would help create a more comfortable girth for the horse.

The materials used to make the girth depend largely upon aesthetics and functionality. Leather is commonly used for horse saddles and saddle accessories because leather is traditional, wears well, and can be tanned to varying degrees of stiffness and appearance. Other materials which may be used for saddle accessories include less traditional synthetics like nylon or natural fiber materials made from cotton or hemp that can wear well and are inexpensive to manufacture, although these types of material are aesthetically and traditionally less desirable.

When leather is used to construct the girth, the outside surface should be made of leather tanned to be relatively stiff and capable of luster. A stiff-tanned leather is resistant to stretching and change of shape. Stiff leather also provides the girth resistance to scuffing and damage and permits the girth to be polished to a luster which is a characteristic that is aesthetically pleasing to many people in the horse industry.

Conversely, the inside surface should be made from a material that is supple and perhaps even absorbent to provide comfort for the horse and absorb perspiration. Any material that provides these characteristics may be used for the inside surface, including soft leather, felt, sheepskin, cotton or other similar types of material.

When using the saddle girth taught by the present invention, the girth is positioned under the horse so that the central portion is directed towards the front of the horse with the opposing straight segments angled to extend upwardly and to the posterior of the central portion. When the girth is located in its proper position, one straight segment of the girth may be removably connected to the far-side of the saddle with the connectors and the corresponding saddle straps. The girth may then be positioned around the chest of the horse forward of the apex of the horse's chest. As discussed above, the girth may be positioned over the sternum which provides the most support for the girth and least amount of discomfort on the horse. Attaching the girth to the saddle may be completed by pulling the saddle straps through the corresponding connectors and lifting up on the saddle straps so that the girth is snug to the body of the horse. The connectors can then be removably attached to the saddle straps to maintain the girth in position and secure the saddle to the horse.

The angle of each straight segment allows the central portion of the girth to be positioned forward of the apex of the horse's chest when the straight segments are removably connected to the saddle. After the saddle girth is tightened in this position, the saddle girth is prevented from moving back on the horse due to the horse's barrel chest shape, and will not slide forward because the girth is limited in length and is fit snug to the horse. By minimizing the opportunity for movement of the saddle girth backward and forward, the saddle remains located in a substantially fixed position on the back of the horse to provide additional safety to a rider and to prevent sores and chafing.

Thus, it may be seen that the saddle girth of the present invention overcomes the disadvantages and limitations associated with the prior art by providing the aforesaid characteristics. The saddle girth securely locates the saddle on the back of the horse in its initial position minimizing the saddle from movement during use. This is accomplished by locating the saddle girth across the sternum area in front of the apex of the horse's chest and removably connecting the saddle girth to traditional style saddles currently used with horses.

The saddle girth also retains its position over the sternum area of the horse to minimize the saddle girth from rubbing against the skin or forelegs to prevent sores and chafing. The girth is prevented from sliding to the posterior portion of the horse by the configuration of the girth and its placement in front of the apex of the horse's chest to limit any discomfort or the chances of internal injury to the horse.

The saddle girth of the present invention also provides a rider with greater stability, comfort and confidence by maintaining the stability of the saddle. Further, the saddle girth is constructed to be comfortable to the horse and capable of absorbing perspiration.

Finally, all of the aforesaid advantages and objectives are achieved without incurring any substantial relative disadvantage.

The above summary sets forth rather broadly the most important features of the present invention so that the detailed description that follows may be better understood, and so that the present contributions to the art may be better appreciated. There are, of course, additional features of the invention that will be described hereinafter, which will form the subject matter of the invention. In this respect, before explaining an embodiment of the invention in detail, it is to be understood that the invention is not limited in its application. The details of the construction and the arrangements set forth in the following description are illustrated in the drawings. However, the present invention is capable of other embodiments and of being practiced and carried out in various ways, as will be appreciated by those skilled in the art. Also, it is to be understood that the phraseology and terminology employed herein are for description and not limitation.

DESCRIPTION OF THE DRAWINGS

These and other advantages of the present invention are best understood with reference to the drawings, in which;

FIG. 5 is a partial side view of a horse with a saddle being held in place on the horse by the saddle girth shown in FIGS. 2–4;

FIG. 6 is a partial plan view of the underside of the horse shown in FIG. 5, showing the placement of the saddle girth of the present invention.

DETAILED DESCRIPTION OF THE PREFERRED EMBODIMENTS

Figure 1:
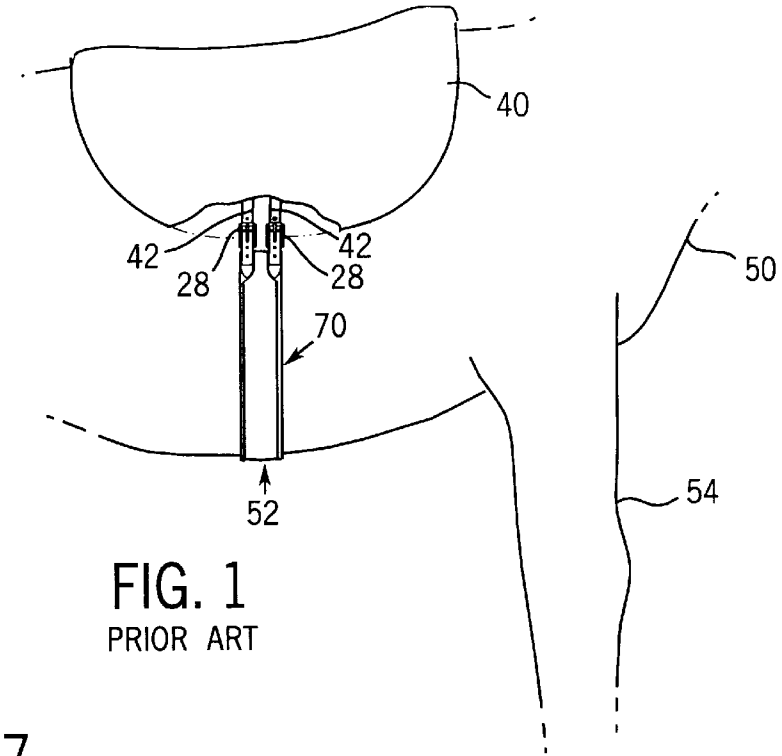
FIG. 1 PRIOR ART
FIG. 1 is a partial side view of a horse with a saddle being held in place on the horse with a girth not in conformance with the girth taught by the present invention.

A traditional girth 70 of the prior art is tightened across the apex 52 of the horse's chest, directly under the point at which the girth 70 is attached to the saddle 40, as shown in FIG. 1. Due to the barrel or rounded shape of the horse's chest, the girth 70 has a tendency to slide forward or backward. This movement loosens the saddle 40 and permits the saddle 40 to move longitudinally along the horse's back, which is both disconcerting and dangerous for a rider and also causes sores and chafing along the horse's chest, withers and back.

Figures 2, 3, 4:
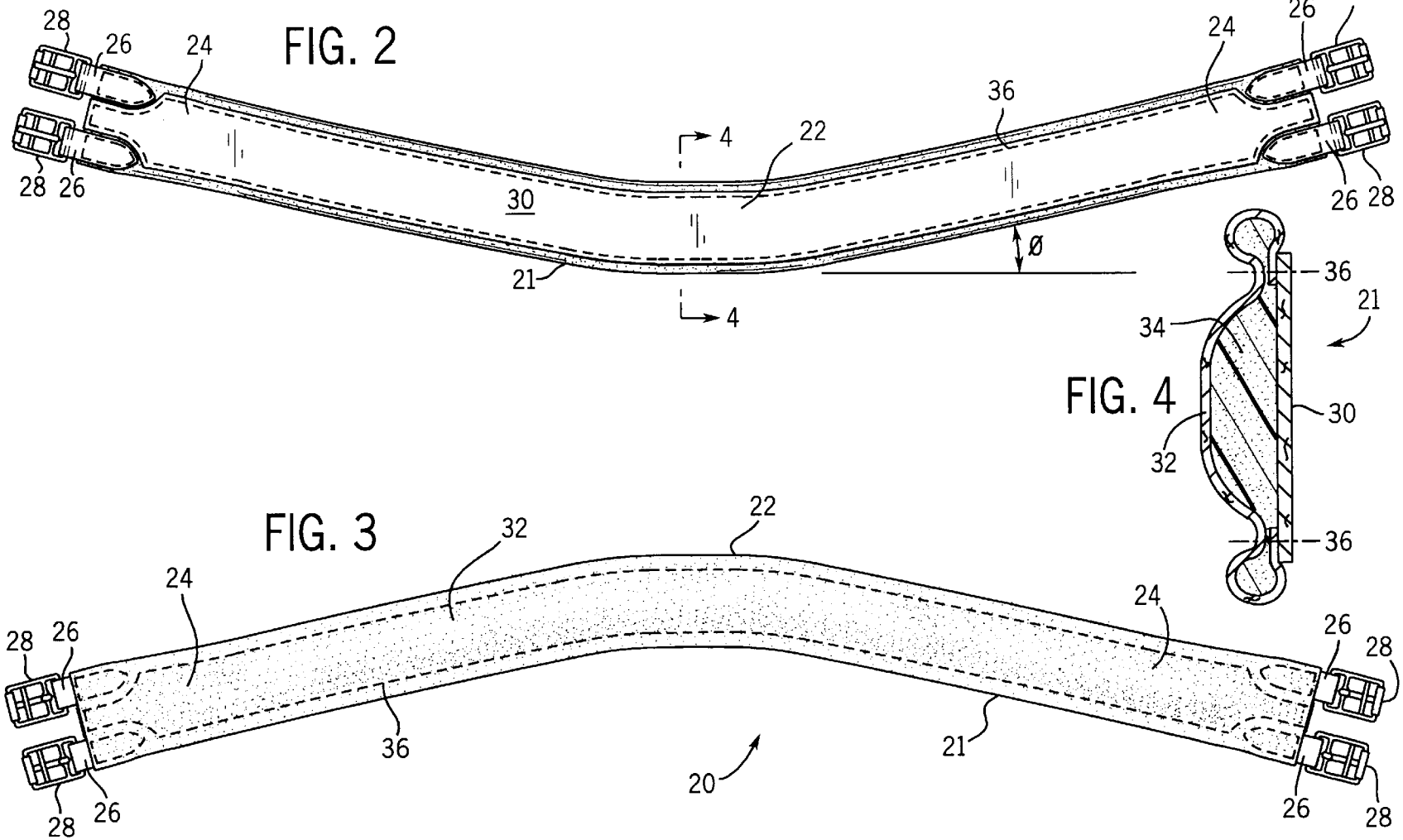
FIG. 2 is a plan view of the front side of a saddle girth in accordance with the teachings of the present invention.
FIG. 3 is a plan view of the back side of the saddle girth as shown in FIG. 2.
FIG. 4 is a cross sectional view of the girth as shown in FIGS. 2 and 3.

FIG. 2 illustrates a saddle girth 20 which is constructed in accordance with the teachings of the present invention. The girth 20 is approximately ten centimeters (10 cm.) wide and has a length between approximately nine-tenths of a meter (0.9 m.) and one and three-tenths meters (1.3 m.) depending on the size and shape of the horse. Generally, the larger the horse, the longer the girth strap 20 must be to wrap around the underside of the horse. Further, the width of the girth 20 may vary depending on the style of girth desired.

The girth 20 includes a girth band 21 with two opposing straight segments 24, each having one or more connectors 28 attached at their respective distal ends, each connector 28 being attached using a corresponding connector strap 26. The connectors 28 are typically buckles that are used to removably attach the girth 20 to a saddle 40 at corresponding saddle straps 42 (illustrated in FIG. 5), but the connectors 28 may be any element that accomplishes such a purpose.

The two opposing segments 24 of the girth band 21 are separated by a central portion 22. The central portion 22 is the area of the girth 20 that is situated under the horse and applies the most force against the horse when used in combination with a saddle 40. The central portion 22 may be constructed at various lengths ranging between zero centimeters (0 cm., meaning no central portion 22 is used) and approximately thirty-two centimeters (32 cm.), depending on the size of the horse and the comfort level to be provided to the horse. The central portion 22 can be individually constructed to match the width of the sternum area of a particular horse, or mass-produced at a predetermined length for all styles of horses.

The two opposing segments 24 each extend away from the central portion 22 at an angle "Ø" less than about forty-five degrees (45°) as measured from the central portion 22. Most often, this angle is between approximately five degrees (5°) and ten degrees (10°) However, the angle "Ø" should increase when the girth 20 is used with larger horses, when the saddle 40 is positioned further back on the horse and/or when the length of the central portion increases so that the girth 20 properly fits the horse 50.

FIGS. 2 and 3 are inverse images of one another displaying the girth 20 as shown from the front side (FIG. 2) and the back side (FIG. 3). The front side view in FIG. 2 shows the outside surface 30 of the girth 20 while the back side view of FIG. 3 depicts the inside surface 32 which faces the horse when the girth 20 is removably attached to the saddle. When the girth is made primarily of leather, the outside surface 30 should be constructed from leather tanned to be relatively stiff and durable to prevent the girth 20 from changing shape, stretching or damage. This is desirable because the outside surface 30 faces away from the horse and will be susceptible to scuffing and damage. In addition, a stiff-tanned leather is capable of being polished to a luster which is appealing to those people that show or judge horses because this adds to the overall appearance of the horse 50.

Unlike the outside surface 30, the inside surface 32 should be constructed from leather tanned to be more supple and absorbent. The inside surface 32 is the portion of the girth 20 that makes contact with the horse. For this reason, the inside surface 32 should provide comfort to the horse. Supple leather is softer and more pliable and will provide more comfort to the horse. Supple leather can also absorb perspiration, which will be more comforting and cleanly.

In alternative embodiments of the girth 20, the outside 30 and inside 32 may be made from material other than leather, or from a combination of materials that may or may not include leather. For example, in some cases the outside 30 may be constructed from leather while the inside is made from a synthetic textile material such as Cambrelle®, a registered trademark of Comtex Fabrics Limited. Other embodiments may be constructed entirely from synthetic materials depending on the quality, look and price characteristics desired for the product. Generally, however, the outside 30 will be more durable and the inside 32 will be more comfortable and absorbent. Under some circumstances, the material used to construct both the outside 30 and the inside 32 could have all of the above-mentioned characteristics, thus eliminating the need for separate materials on the outside surface 30 and inside surface 32.

FIG. 4 illustrates a cross-sectional view of the girth band 21. The outside surface 30 and the inside surface 32 are joined together by stitching 36, although others may employ well-known alternative methods of joining fabrics and materials. To provide additional comfort to the horse in the preferred embodiment, a cushion 34 is placed between the outside surface 30 and the inside surface 32. The cushion 34 is held in place by the sandwich-type construction of the girth band 21 between the outside surface 30, the inside surface 32 and the stitching 36. The cushion may be made from most any material capable of being compressed and/or absorbing shock including foam rubber, neoprene, latex, sponge, gel or other similar types of materials. In an alternative embodiment, the inside surface 32 may completely enclose the cushion 34 and be joined along a seam running the length of the girth band 21. The outside surface, if required, could then be joined to one side of the inside surface. Other embodiments may not even use a cushion 34.

FIG. 5 depicts the girth 20 used in combination with a saddle 40 and a horse 50. The girth 20 is removably attached to the saddle 40 with the connectors 28 attached to the distal end of each opposing segment 24 by the connector straps 26. The connectors 28 are typically buckles made from various metals or plastics and have a mechanism to adjustably attach the girth 20 to the saddle straps 42 so that the girth 20 may be secured to the saddle 40. This mechanism is most often a tongue and frame construction of a conventional buckle, but may be any other mechanism known which achieves the same result. The combination of the saddle straps 42 and the connectors should also allow the girth 20 to be tightened around the horse 50 so that the saddle 40 will be firmly secured to the horse 50.

In the preferred embodiment, the saddle straps 42 may be pulled through the corresponding connectors 28 and lifted so as to tighten the girth 20 around the horse 50. When the girth is taut, the connectors 28 will bind the corresponding saddle straps 42 with the tongue of the buckle through the punch holes of the saddle straps 42 to hold the girth 20 firmly against the horse 50. The connectors 28 and the saddle straps 42 should be constructed to withstand considerable force and stress so that the girth 20 remains removably connected to the saddle 40 to prevent the saddle 40 from falling off the horse 50 and providing safety for a rider. Although this is the preferred embodiment, other methods of connecting girths to saddles are known to those skilled in the art.

When the girth 20 is removably attached to the saddle 40, the girth 20 angles downwardly and towards the front portion of the horse forward of the point at which the girth 20 is attached to the saddle 40, as shown in FIG. 5. The girth 20 sets forward on the horse 50 due to the angle that the straight segments 24 each extend away from the central portion 22 as more clearly shown in FIG. 6. The angles place the girth 20 across the horse 50 so that the central portion 22 sets forward of the apex 52 of the horse's chest and is directed towards the forelegs 54.

The forward placement of the girth 20 across the front portion of the horse's chest or sternum area inhibits the girth 20 from sliding back and forth along the horse's chest. The girth is prevented from moving backward along the chest towards the posterior portion of the horse by the apex 52 of the chest. The length of the girth 20 and the configuration of the horse's chest limit any forward movement towards the forelegs 54. By positioning the girth 20 in this position, virtually all movement of the girth 20 and the saddle 40 is eliminated, a significant improvement over traditional girths.

Figure 7:
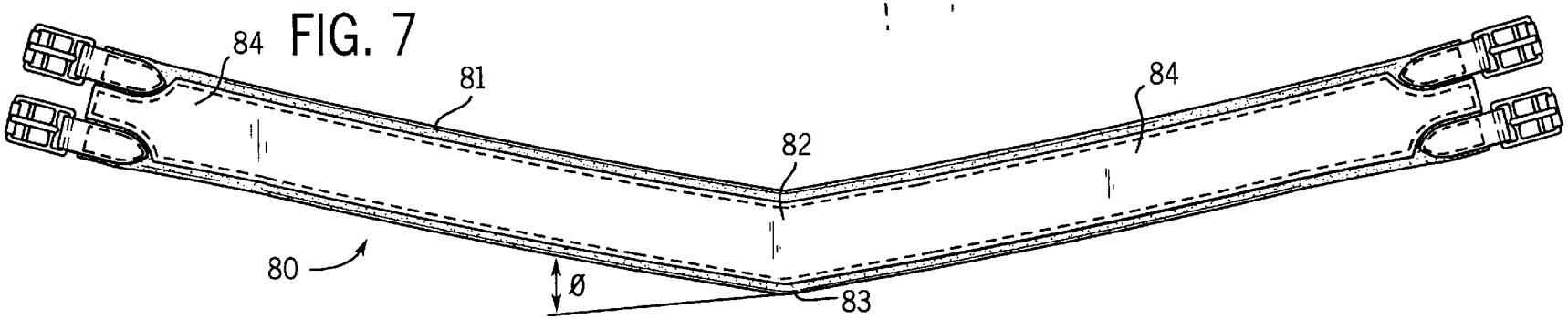
FIG. 7 is a plan view of the front side of an alternative embodiment saddle girth taught in accordance with the present invention.

FIG. 7 depicts an alternative embodiment of a girth 80 of the present invention where the girth band 81 is in shape substantially similar to that of a true chevron. The two opposing segments 84 of the girth band 81 each extend at an angle from a central portion 82, the angle being less than approximately forty-five degrees (45°) from straight to form a generally "V" shape. Unlike the central portion 22 of the primary embodiment, the central portion 82 has a minimal length between about zero and two centimeters and may form a true or rounded point 83.

As with the other embodiments of the present invention, the central portion 82 is placed across the horse's chest forward the point at which the girth 80 is removably attached to the saddle 40. This is accomplished by facing the point 83 of the central portion 82 towards the forelegs 54, with the straight segments 84 extending up to the saddle straps 42 at their respective angles. Again, the angle that the straight segments 84 extend away from the central portion 82 is dependent on the size and shape of the horse and the position of the saddle 40 on the horse.

Other advantages and features of this invention will become apparent from the claims made thereto, with the scope thereof determined by the reasonable equivalents, as would be understood by those skilled in the art.

What is claimed is:

1. A saddle girth used to secure a saddle to the back of a horse, said saddle girth comprising:

a girth band consisting of two straight segments and a central portion separating said two straight segments, said straight segments being connected to and extending away from said central portion at an angle in the same direction such that said straight segments lie in the same plane;

at least one connector strap affixed to each of said straight segments at a free end thereof; and a connector attached to each said connector strap for removably fastening said saddle girth to said saddle.

2. The saddle girth of claim 1, wherein each said straight segment extends away from said central portion at an angle less than approximately forty-five degrees.

3. The saddle girth of claim 1, wherein each said straight segment extends away from said central portion at an angle between approximately one and thirty degrees.

4. The saddle girth of claim 1, wherein each said straight segment extends away from said central portion at an angle between approximately five and ten degrees.

5. The saddle girth of claim 1, wherein said central portion has a length not exceeding about thirty-two centimeters.

6. The saddle girth of claim 1, wherein two connector straps are affixed to each of said straight segments and extend beyond a free end thereof.

7. The saddle girth of claim 1 further comprising a cushion attached to said girth band and extending along substantially the entire length of said girth band.

8. A girth for use in combination with an English saddle and a horse, said girth comprising:

a girth band consisting of a central portion and two segments being connected to and extending away from said central portion in like directions at an angle less than approximately forty-five degrees such that said two segments lie in the same place;

an outside surface joined to said girth band;

a cushion located between said outside surface and said girth band;

at least one connector strap attached to each said segment of said girth band; and a connector attached to each said connector strap.

9. The girth of claim 8, wherein said outside surface and said girth band are constructed from leather.

10. The girth of claim 9, wherein said outside surface is constructed from a more stiff leather than the leather used to construct said girth band.

11. The girth of claim 8, wherein said central portion has a length between approximately zero centimeters and thirty-two centimeters.

12. The girth of claim 8, wherein said angle that each said segment extends away from said central portion is between approximately five and thirty degrees.

13. A method of making a saddle girth to prevent a saddle from moving longitudinally along the back of a horse, said method comprising the steps of:

positioning said girth under said horse, said girth including:

a girth band consisting of two opposing segments and a central portion separating each said segment, each said segment being connected to and extending away from said central portion at an angle less than approximately forty-five degrees such that said two opposing segments lie in the same plane;

at least one connector strap joined to each said segment; and a connector attached to each said connector strap, so that said central portion is directed towards the forelegs of said horse and each said segment angles towards the posterior of the horse;

removably attaching one said segment of said girth to a side of said saddle using said connector; and securing said girth to an opposite side of said saddle with said connector attached to the opposite said segment.

14. The method of claim 13 further comprising the step of tightening said girth to said saddle so that said central portion of said girth band rests over the sternum area of said horse forward of the apex of the horse's chest.

15. The method of claim 13, wherein said connector is a buckle having a frame and a tongue.

16. The method of claim 13, wherein said central portion forms substantially a point where each said segment converges at said central portion.

17. The method of claim 13, wherein said girth has a length between approximately nine-tenths of a meter and one-and-three-tenths meters.

18. The method of claim 13, wherein said central portion has a length substantially the same as the sternum of the horse.

19. A girth comprising:

a girth band consisting of a central portion a central portion and two opposing segments separated by said central portion, each said opposing segment being connected to and extending away from said central portion at an angle less than approximately forty-five degrees in the same direction such that said two opposing segments lie in the same plane; and at least one connector attached to each segment for removably attaching said girth to a saddle.

20. The girth of claim 19, wherein said girth band is constructed from a single piece of material.

21. The girth of claim 19 further comprising:

an outside surface joined to said girth band; and a cushion located between said outside surface and said girth band.

22. The girth of claim 21, wherein said outside surface and said girth band are constructed from leather.

23. The girth of claim 22, wherein said girth band is constructed from leather tanned to be more supple than the leather used to construct said outside surface.

24. The girth of claim 21, wherein said outside and said girth band are joined by stitching.

25. The girth of claim 19 further comprising a cushion attached to said girth band so that when said girth is used in combination with a saddle and a horse said cushion contacts said horse.

26. The girth of claim 25, wherein said cushion is absorbent.

27. A saddle girth for use in combination with an English saddle and a horse, said saddle girth comprising:

an outside surface consisting of a central portion with a length less than approximately thirty-two centimeters and two opposing straight segments being connected to and extending away from said central portion at an angle less than approximately forty-five degrees in like directions such that said of two opposing straight segments lie in the same plane, each said opposing straight segment having a free end distal from said central portion and having a length sufficient to wrap around the underside of said horse between opposite sides of said English saddle;

an inside surface joined to said outside surface, a cushion situated between said inside surface and said outside surface;

at least two connector straps attached to each said opposing straight segment, said connector straps extending beyond said free end of each said opposing straight segment; and a connector configured for attachment to each said connector strap, said connector used to removably attach said English saddle to said saddle girth.

28. The saddle girth of claim 27, wherein said inside surface and said outside surface are joined by stitching.

29. The saddle girth of claim 27, wherein said connector is a buckle.

30. A girth for use in combination with a saddle and a horse having a rounded chest, said girth comprising:

an outside surface consisting of a central portion with a length less than approximately thirty-two centimeters and two opposing straight segments being connected to and extending away from said central portion at an angle less than approximately forty-five degrees in like directions such that said two opposing straight segments lie in the same plane, each said opposing straight segment having a free end distal from said central portion and having a length sufficient to wrap around the underside of said horse between opposite sides of said saddle;

an inside surface joined to said outside surface, said inside surface being constructed from a cushioning material;

at least two connector straps attached to each said opposing straight segment, said connector straps extending beyond said free end of each said opposing straight segment; and a connector configured for attachment to each said connector strap, said connector used to removably attach said saddle to said girth to secure said saddle to the back of said horse.

31. A saddle girth used to secure a saddle to the back of a horse, said saddle girth comprising:

a girth band consisting of two straight segments separated by a central portion, said straight segments each being connected to and extending away from said central portion at an angle in the same direction to form a chevron shape;

at least one connector strap affixed to each of said straight segments at a free end thereof; and a connector attached to each said connector strap for removably fastening said saddle girth to said saddle.

32. A saddle girth used to secure a saddle to the back of a horse, said saddle girth comprising:

a girth band consisting of a central portion and two opposing segments separated by said central portion, wherein each of said opposing segments is connected to and extends away from said central portion at an angle less than approximately forty-five degrees in the same direction to form a chevron shape; and at least one connector attached to each segment at a free end thereof for removably attaching said girth to billet straps on the side of a saddle; wherein said central portion of said girth band may be placed over the sternum of the horse and will remain there due to its chevron shape.

* * * * *